US011229247B2

(12) United States Patent
Tirro et al.

(10) Patent No.: US 11,229,247 B2
(45) Date of Patent: Jan. 25, 2022

(54) CONVERTIBLE JACKET AND BAG

(71) Applicants: Grace Tirro, Staten Island, NY (US); Morgan Schlaugies, Greenlawn, NY (US)

(72) Inventors: Grace Tirro, Staten Island, NY (US); Morgan Schlaugies, Greenlawn, NY (US)

( * ) Notice: Subject to any disclaimer, the term of this patent is extended or adjusted under 35 U.S.C. 154(b) by 0 days.

(21) Appl. No.: 14/945,385

(22) Filed: Nov. 18, 2015

(65) Prior Publication Data

US 2016/0157535 A1 Jun. 9, 2016

Related U.S. Application Data

(60) Provisional application No. 62/081,928, filed on Nov. 19, 2014.

(51) Int. Cl.

| | |
|---|---|
| ***A41D 15/04*** | (2006.01) |
| ***A41D 1/02*** | (2006.01) |
| ***A45F 4/12*** | (2006.01) |
| *A41D 27/00* | (2006.01) |

(52) U.S. Cl.

CPC ..... *A41D 15/04* (2013.01); *A41D 1/02* (2013.01); *A45F 4/12* (2013.01)

(58) Field of Classification Search

CPC . A41D 15/04; A41D 1/02; A41D 1/04; A41D 15/007; A45F 4/12; A45F 2004/003

USPC ..... 2/72, 86, 93, 108

See application file for complete search history.

(56) References Cited

U.S. PATENT DOCUMENTS

| | | | | | |
|---|---|---|---|---|---|
| 2,058,474 | A | * | 10/1936 | Long | A41D 15/04 2/85 |
| 2,143,243 | A | * | 1/1939 | Hirschman | B41K 1/04 101/150 |
| 2,146,243 | A | * | 2/1939 | Aug | A41D 15/04 150/107 |
| 4,227,264 | A | | 10/1980 | Spector et al. | |
| 4,347,629 | A | * | 9/1982 | Itoi | A41D 3/00 2/108 |
| 4,404,687 | A | * | 9/1983 | Hager | A41D 3/005 2/94 |
| 4,475,251 | A | * | 10/1984 | Hopkins | A45C 9/00 2/85 |
| 4,476,587 | A | * | 10/1984 | Itoi | A41D 3/005 2/94 |
| 4,483,469 | A | * | 11/1984 | Arisland | A45F 4/12 224/582 |
| D277,049 | S | * | 1/1985 | Peyser | 2/93 |
| 4,502,154 | A | * | 3/1985 | Itoi | A41D 3/00 2/108 |

(Continued)

FOREIGN PATENT DOCUMENTS

| | | |
|---|---|---|
| WO | WO2008121106 | 10/2008 |

OTHER PUBLICATIONS

RuckJack, the jacket that converts to a backpack, http://gadgets.boingboing.net/2009/03/02/ruckjack-the-jacket.html.

*Primary Examiner* — Robert H Muromoto, Jr.
(74) *Attorney, Agent, or Firm* — Dara L. Onofrio, Esq.; Onofrio Law

(57) ABSTRACT

A convertible garment comprising a jacket portion with an inner and outer surface; and a pouch on the inner surface of the jacket portion; wherein the pouch is open ended on one side and includes a drawstring.

12 Claims, 7 Drawing Sheets

(56) References Cited

U.S. PATENT DOCUMENTS 4,502,155 A * 3/1985 Itoi ..... A41D 3/00 2/115
4,563,777 A * 1/1986 Park ..... A41D 15/04 2/108
4,637,076 A 1/1987 Tartt et al.
4,700,409 A * 10/1987 De Lott ..... A45F 4/12 2/102
4,862,520 A * 9/1989 Gazzola ..... A41D 15/04 2/69
4,932,574 A * 6/1990 Doshi ..... A41D 15/04 2/94
4,944,042 A * 7/1990 DeWan ..... A45F 4/12 2/94
5,123,117 A * 6/1992 Prendergast ..... A45F 4/12 2/108
5,165,111 A * 11/1992 Lieberman ..... A41D 15/04 2/108
5,450,629 A * 9/1995 Gilstrap ..... A42B 1/062 2/10
D369,899 S 5/1996 Regan et al.
5,526,969 A 6/1996 Greenberger
5,564,125 A * 10/1996 Waldman ..... A41D 3/00 2/93
5,699,560 A * 12/1997 Greenberg ..... A41D 3/00 2/108
5,784,719 A * 7/1998 Robinson ..... A41D 3/00 2/93
5,787,504 A * 8/1998 Wu ..... A41D 15/04 2/93
5,850,634 A * 12/1998 Toombs ..... A41D 15/04 2/93
5,996,121 A * 12/1999 Harris ..... A41D 15/04 2/108
6,256,794 B1 * 7/2001 Erickson ..... A42B 1/201 2/171.03
6,317,892 B1 * 11/2001 Galigani ..... A42B 1/201 2/209.11
6,370,692 B1 * 4/2002 Duyn ..... A41D 3/02 2/86
6,385,775 B1 * 5/2002 Komjati ..... A41D 15/04 2/86
6,405,377 B1 * 6/2002 Davis ..... A41D 15/04 2/108
7,363,659 B1 * 4/2008 Colbert ..... A41D 3/00 2/86
7,395,555 B2 * 7/2008 Aldridge ..... A41D 13/02 2/69
7,575,376 B2 * 8/2009 Yu ..... A45C 7/0077 190/103
D626,725 S * 11/2010 Snyder ..... D2/830
8,424,114 B2 * 4/2013 Snyder ..... A47C 16/00 2/86
8,429,763 B2 * 4/2013 Hawbaker ..... B65D 33/28 2/86
D683,524 S 6/2013 Power
8,510,865 B2 8/2013 Pyfer et al.
9,788,584 B2 * 10/2017 Koo ..... A45F 4/12
2002/0088048 A1 * 7/2002 Turner ..... A41D 15/005 2/93
2003/0033658 A1 * 2/2003 Hinnant ..... A41D 3/02 2/93
2005/0056669 A1 * 3/2005 Lavelle ..... A41D 3/08 224/153
2005/0091724 A1 * 5/2005 Snyder ..... A41D 15/04 2/86
2005/0198723 A1 * 9/2005 Green, III ..... A41D 15/04 2/93
2005/0231899 A1 * 10/2005 Barnes ..... G06F 1/1628 361/679.55
2006/0000004 A1 * 1/2006 Elen ..... A41D 3/00 2/108
2006/0150297 A1 * 7/2006 Turner ..... A41D 3/00 2/69
2007/0083983 A1 * 4/2007 Barclay ..... A41D 3/00 2/227
2007/0194072 A1 * 8/2007 Irwin Guzinski ..... A41D 15/04 224/576
2007/0204375 A1 * 9/2007 Issei ..... A41D 7/008 2/69
2008/0235849 A1 * 10/2008 McCray-Clark ..... A41D 15/04 2/85
2009/0055991 A1 * 3/2009 Johnson ..... A41D 1/04 2/84
2009/0205096 A1 * 8/2009 Seemann ..... A41D 15/04 2/4
2009/0205102 A1 * 8/2009 Anderson ..... A41D 3/00 2/85
2010/0031413 A1 * 2/2010 Jensen ..... A41D 15/04 2/69.5
2010/0111448 A1 * 5/2010 Li ..... A41D 15/04 383/4
2010/0122395 A1 * 5/2010 Wall ..... A41D 15/04 2/84
2010/0127025 A1 * 5/2010 Kelling ..... A41D 15/04 224/153
2010/0282803 A1 * 11/2010 Simmons ..... A41D 13/0007 224/576
2010/0320241 A1 * 12/2010 Thompson ..... A41D 15/04 224/153
2011/0079623 A1 * 4/2011 McCray-Clark ..... A41D 15/04 224/576
2012/0312850 A1 * 12/2012 Killion ..... A45F 3/04 224/576
2013/0081195 A1 * 4/2013 Faridoon ..... A41D 27/20 2/102
2013/0212770 A1 * 8/2013 Lettieri ..... A41D 15/04 2/84
2013/0239290 A1 * 9/2013 Rossi ..... A41D 7/008 2/84
2013/0326794 A1 12/2013 Ortiz
2014/0090147 A1 * 4/2014 Tyler ..... A45F 4/12 2/69

* cited by examiner

CONVERTIBLE JACKET AND BAG

This application claims the benefit of U.S. provisional application No. 62/081,928 filed Nov. 19, 2014, which is incorporated herein in its entirety by reference.

FIELD OF THE INVENTION

The present invention relates to convertible garment. More particularly, the invention is convertible garment in which a jacket transforms into a handbag and vice versa.

BACKGROUND OF THE INVENTION

While out at concerts, dance clubs, having dinner, or other similar venues, it is inconvenient for individuals to have to focus on where to put their jackets or outer garments, without them getting lost, stolen or dirty.

While some venues have coat check windows, It is annoying to wait in long lines for check in and pick up and to have to pay extra money to put your jacket in the closet. If you do not use the coat check you are forced to hold on to your jacket or watch it all night to make sure no one steals it.

The invention garment solves these problems by providing a jacket that has the ability to turn into a bag. The bag can then be easily handled by the individual without stress or worry.

The convertible garment of the invention combines a jacket and a bag that can easily be transformed from one to the other. Preferably the design is a fashion forward jacket that transforms into a convenient light weight shoulder strap bag. The jacket has the ability to fold inside out and turn into a fashionable hand bag.

The garment has a pouch on the inside back surface of the jacket with the straps inside the pouch. To transform into the bag, you simply fold the jacket inside the pouch and close the bag by pulling the strap.

The prior art has shown convertible garments as illustrated in representative patents including U.S. Pat. Nos. 4,227,264, 4,637,076, 5,536,969, 5,996,121, 7,575,376, 8,510,865, D369,899 and D683,524; U.S. Patent Publication Nos. 2009/0055991, 2010/0111448, 2013/0326794, and International PCT Publication WO 2008121106.

U.S. Pat. Nos. 4,404,687, 5,787,504, 5,850,634 and 6,405,377 disclose convertible garments which transform a bag into a jacket and vice versa.

RuckJack is a jacket with clips that allow it to be easily converted into a backpack (https//.gadgets.boingboing.net/2009/03/02ruckjack-the-jacket.html).

However, none of these references disclose a convertible garment that can easily transform between a jacket and a bag by turning a pouch inside out and including drawstring straps which are used to close the bag.

Accordingly, there is a need for individuals to be able to transform their fashionable jacket into a trendy handbag without the need or worry about losing their garment or handbag.

The advantage of the invention is to provide such a transformable garment that can easily convert between a bag and a jacket.

An advantage of the invention is to permit the user to have both a trendy and fashionable jacket and bag in one garment.

SUMMARY OF THE INVENTION

In the present invention, these purposes, as well as others which will be apparent, are achieved generally by a convertible garment comprising a jacket with a pouch on an inner surface that is easily converted into a handbag.

The pouch includes a drawstring. The jacket folds inside the pouch to form a handbag. Once the jacket is folded within the pouch the drawstring is used to close the handbag to secure contents inside the bag.

Other objects, features and advantages of the present invention will be apparent when the detailed description of the preferred embodiments of the invention are considered with reference to the drawings, which should be construed in an illustrative and not limiting sense.

DETAILED DESCRIPTION OF THE INVENTION

In accordance with the invention, and as illustrated in FIG. 1, the steps illustrated show how both the jacket embodiment and the handbag embodiment are easily transformed into each other.

Figure 1A:
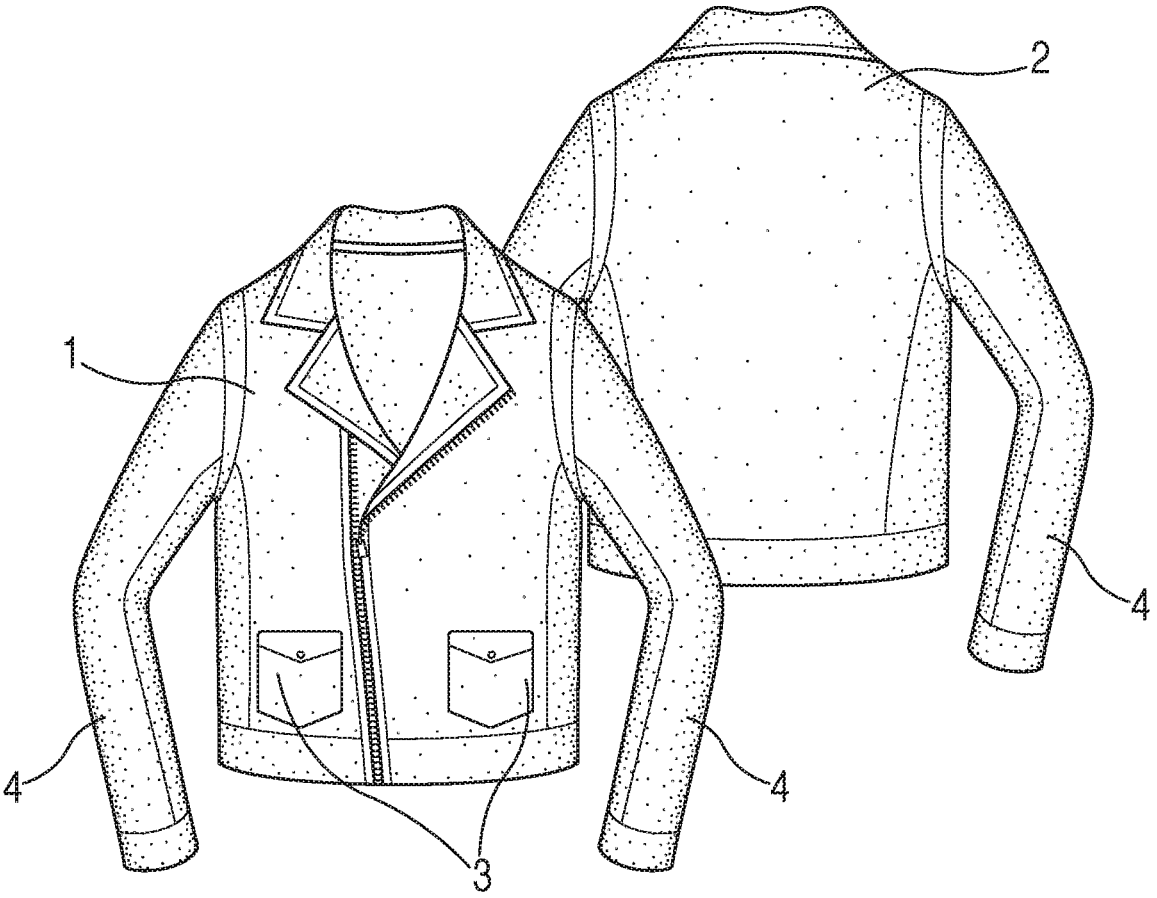
FIGS. 1A to 1F illustrate the convertible garment of the invention and the steps in transforming from a jacket into a handbag.

FIG. 1A illustrates Step 1 which shows the front 1 and back 2 surfaces of the jacket portion of the convertible garment. In an alternate embodiment, the front portion of the jacket has pockets with snap buttons 3, or alternatively zippers. The jacket portion also includes two arm sleeves 4.

Figure 1B:
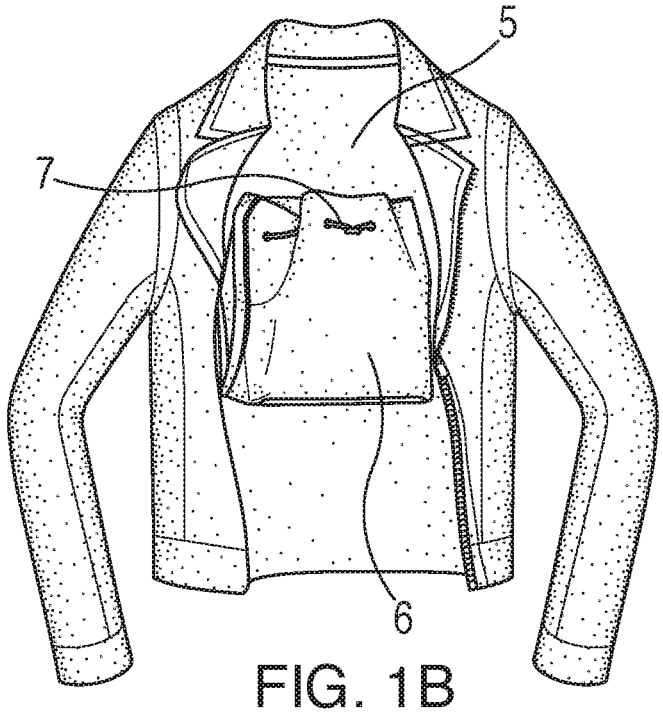

FIG. 1B illustrates Step 2 which shows a pouch 6 on the inner back surface of the jacket 5. A drawstring 7 is looped along the top of the pouch.

Figure 1C:
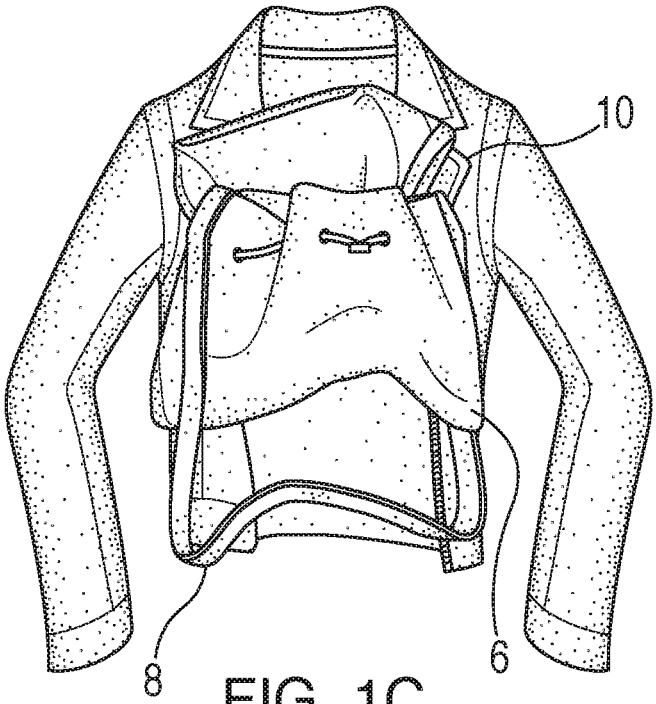

FIG. 1C illustrates Step 3 which shows the bag 6 inside of the jacket turned inside out. The user folds the jacket 10 into the bag 6, releasing the shoulder straps 8. The shoulder straps also function as a drawstring to close the bag securely. Thus, the shoulder strap and drawstring are one in the same.

Figure 1D:
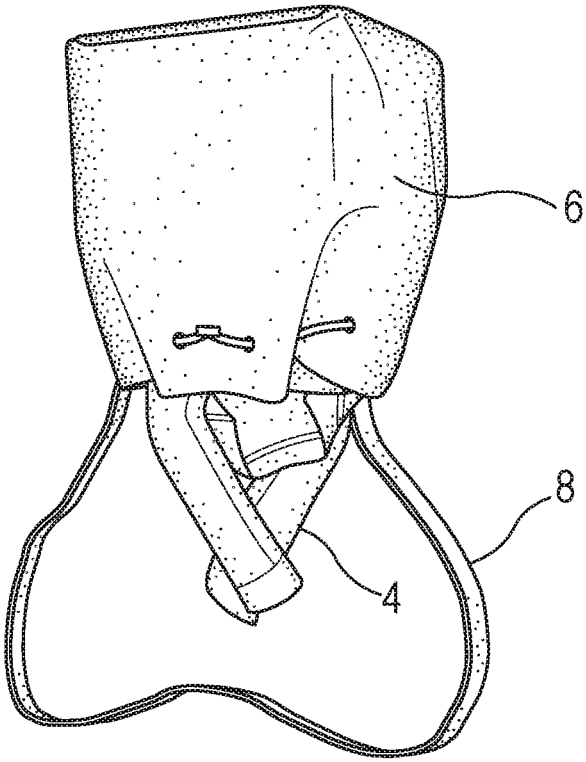

FIG. 1D illustrates Step 4 which shows the jacket almost completely folded into the bag 6 while the straps 8 are pulled. The illustration shows the sleeve arms 4 not quite tucked into the bag itself yet. If snap buttons are used, they are connected to the inner side of the bag (shown below in FIG. 1E).

Figure 1E:
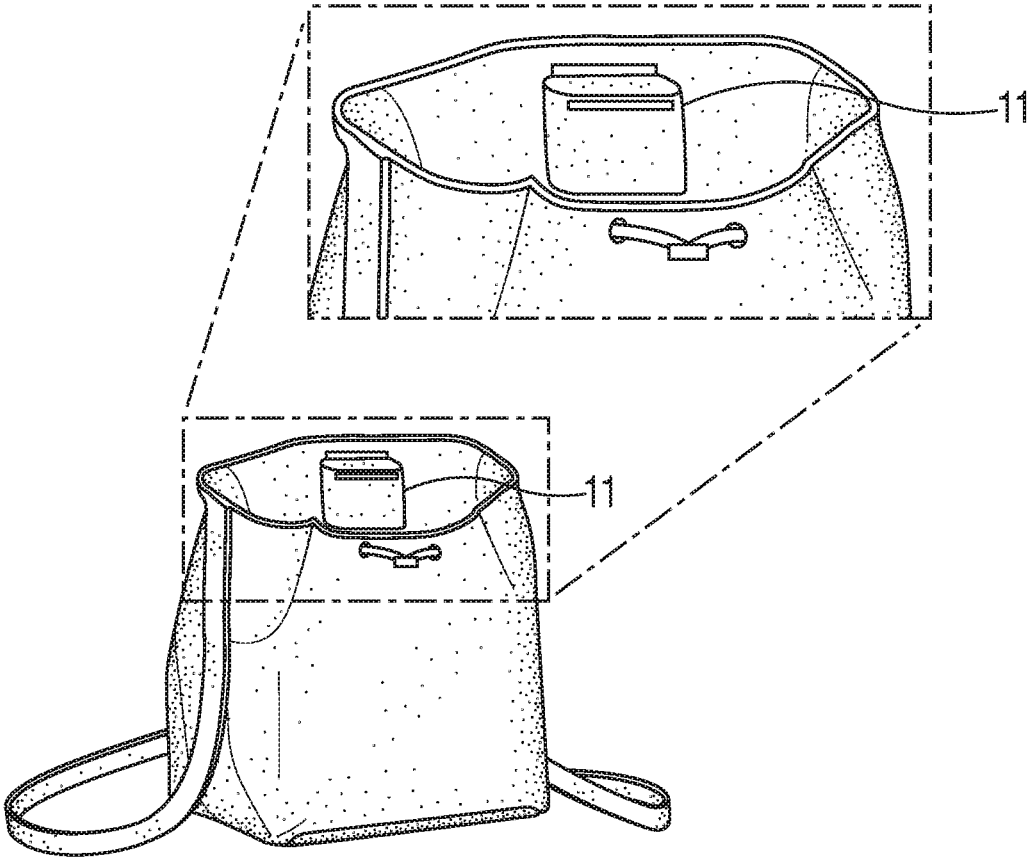

FIG. 1E illustrates Step 5 which shows a close up of the snap buttons connecting to form a functional pocket 11. In embodiments where there are snap buttons used, preferably there is a first snap button on the outer pocket of the jacket which then connects with a second snap button which is located on the inner side of the bag. The purpose of this is to keep all personal items, i.e. phones, keys, wallet, etc. in the pocket for easy access but secure enough to not fall out.

When wearing the jacket embodiment, all personal belongings are held in the pockets. In order for them to be accessed when converting into a bag, the pocket has a button that will be snapped on inside the bag allowing for easy access for personal items. Therefore these items do not have to be taken out before transforming it into a bag.

Figure 1F:
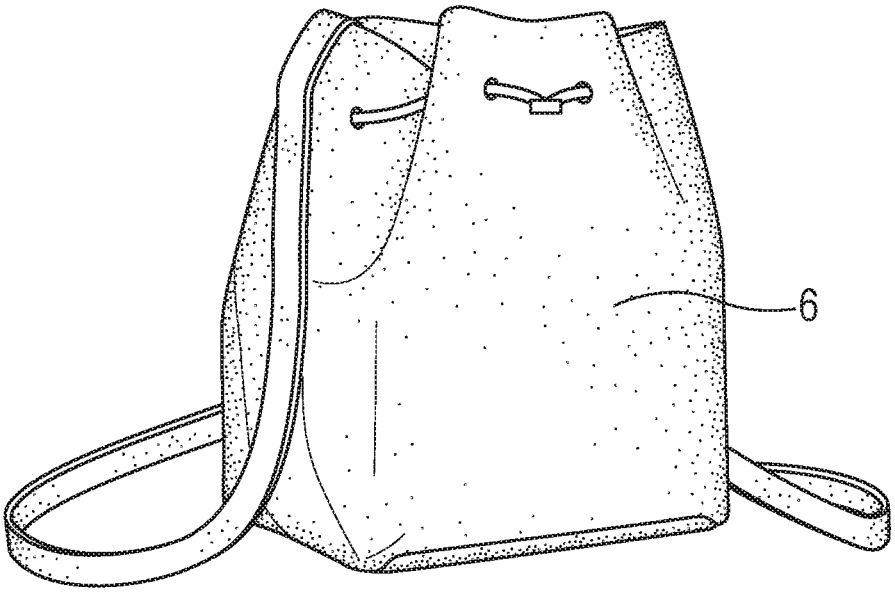

Finally, FIG. 1F illustrates Step 6 which is the handbag 6 of the invention with the jacket folded and secure inside it.

In general, a trendy cotton jacket with an artificial leather pouch on the inside is transformed into a bag. The pouch located on the inner back of the jacket has straps inside. To transform into the bag, one must simply turn the pouch inside out which folds the jacket into it and it closes by pulling the strap.

Figure 2A:
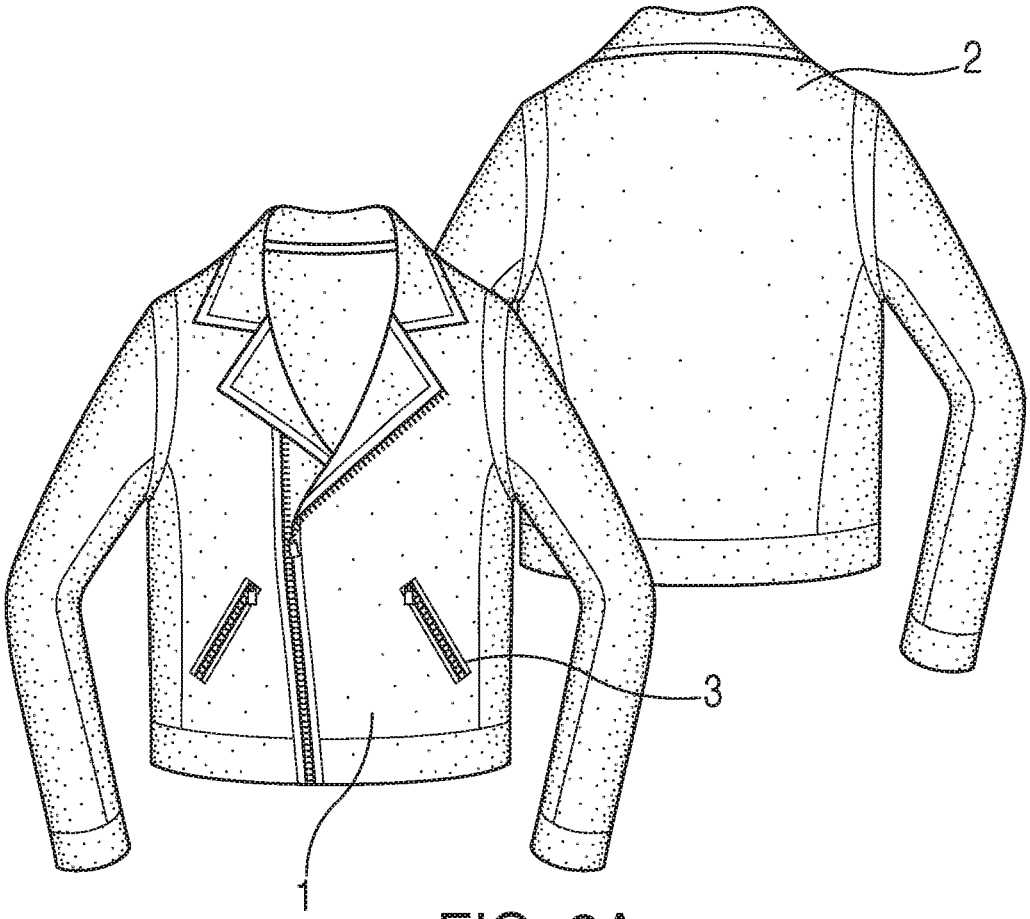
FIGS. 2A to 2D illustrate another embodiment of the convertible garment of the invention and steps in transforming from a jacket into a handbag.
Figure 2B:
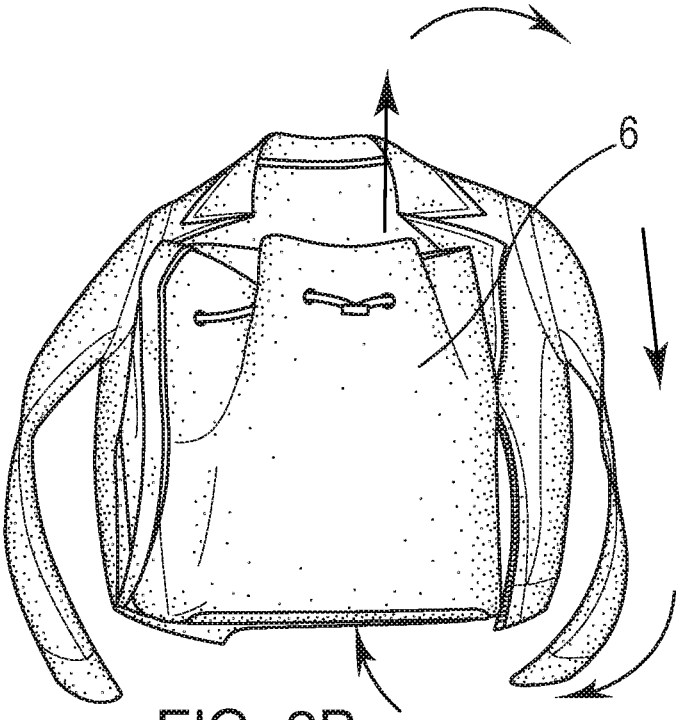
Figure 2C:
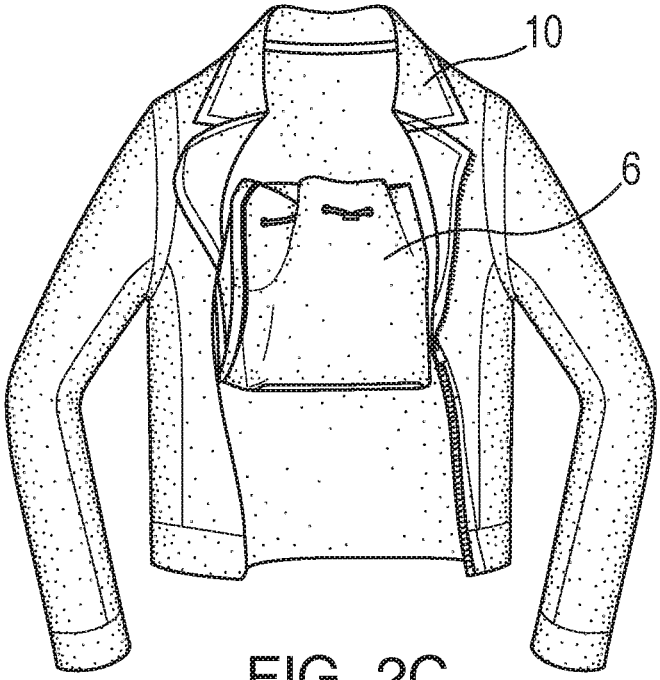
Figure 2D:
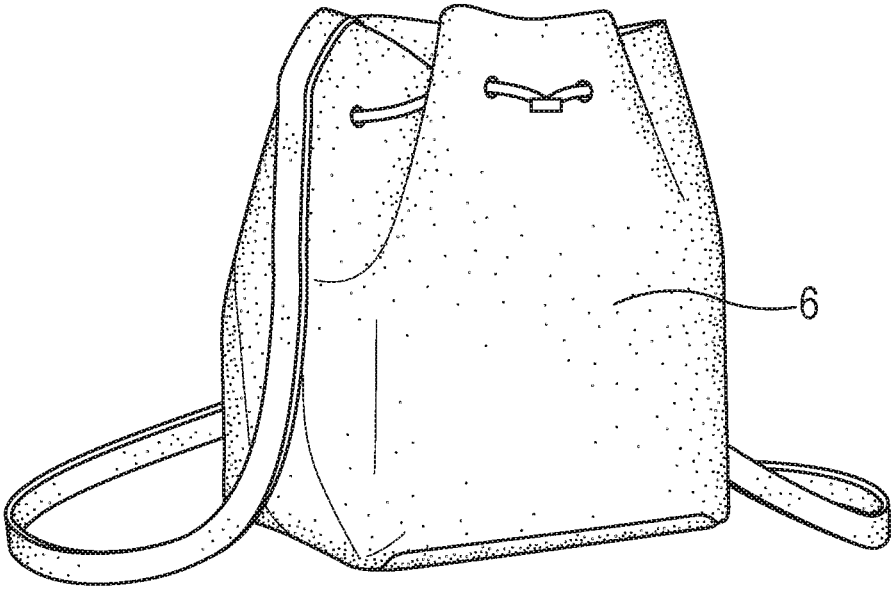
Figure 3A:
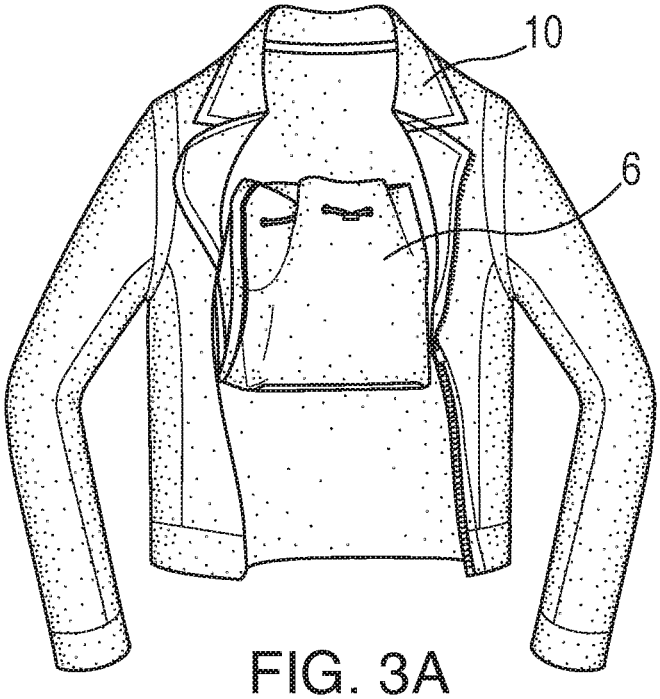
FIGS. 3A to 3D illustrate another embodiment of the convertible garment of the invention and steps in transforming from a jacket into a handbag.
Figure 3B:
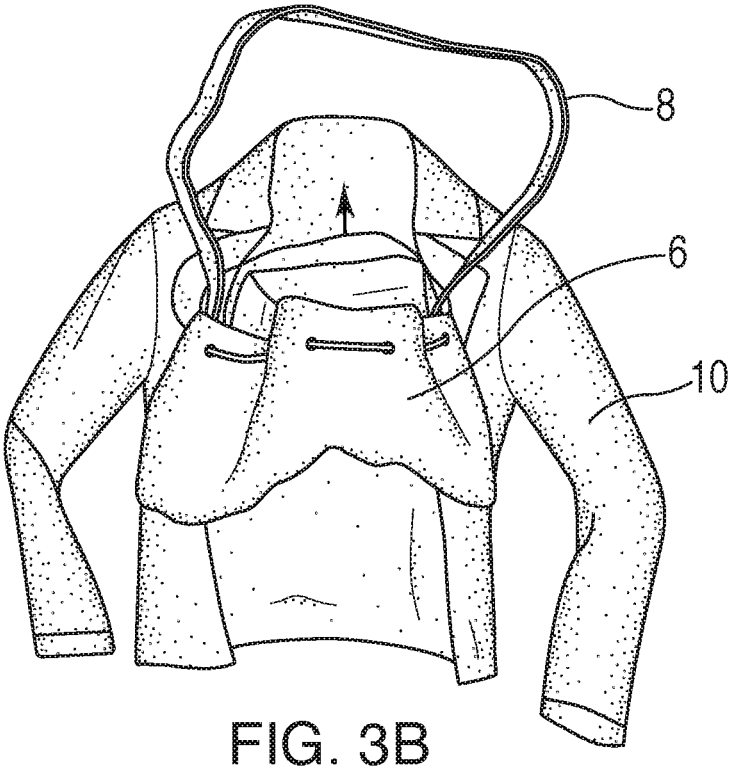
Figure 3C:
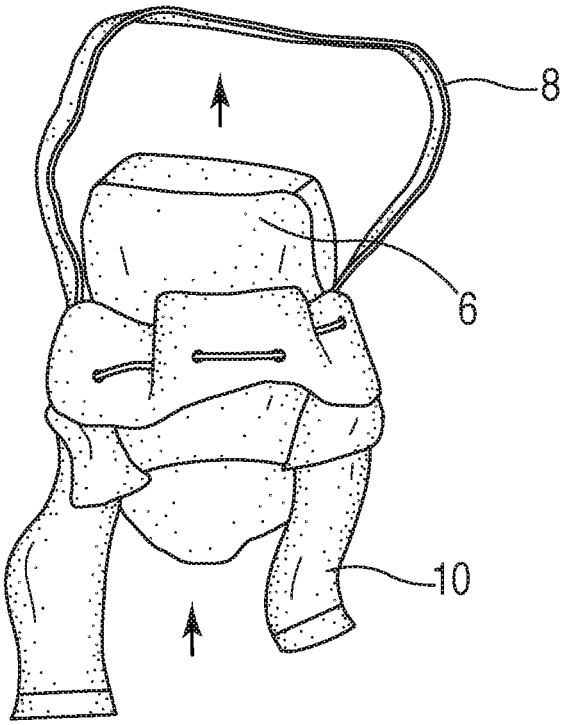
Figure 3D:
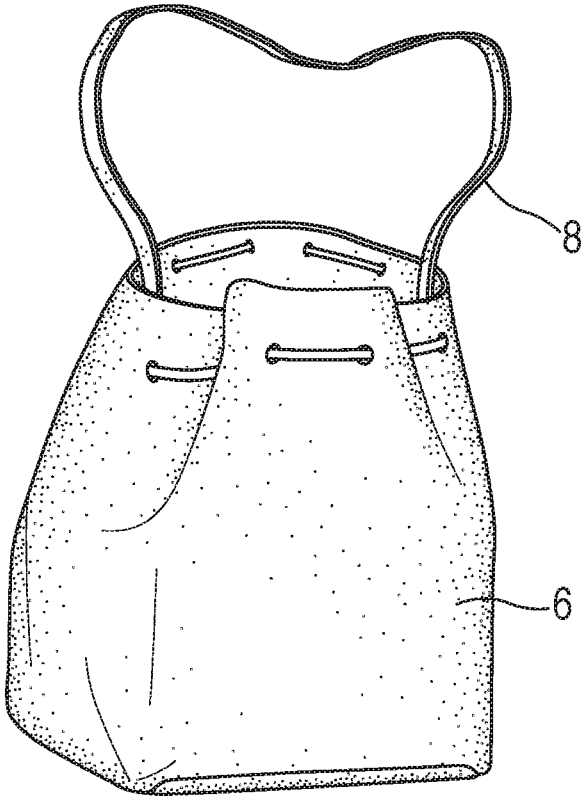

FIG. 2A to 2D illustrates another embodiment of the steps of transforming the jacket into a handbag. Specifically, FIG. 2A illustrates the front 1 and back 2 sides of the jacket portion of the invention with horizontal front pockets 3. FIG. 2B illustrates the directional motion of turning the pouch 6 inside out while the user folds the jacket portion inside the pouch 6. FIG. 2C shows the pouch 6 on the inner surface of the jacket portion 10. FIG. 2D shows the jacket portion completely folded into the bag 6.

FIG. 3 illustrates another embodiment of the steps of transforming the jacket into a handbag. FIG. 3A illustrates the jacket portion 10 of the invention with the pouch 6 on the inner surface. FIGS. 3B and 3*c* illustrates the directional motion of turning the pouch 6 turning inside out while the user folds the jacket portion inside the pouch 6. FIG. 3D shows the jacket portion completely folded into the bag 6 with the shoulder straps 8.

Materials used in the creation of the convertible garment of the invention include, cotton, leather, synthetic leather, nylon, fleece, synthetic materials, polyester, rayon, spandex, lace, down and down feather.

Closures other than the drawstring and snap buttons that can be used in the invention include zippers, buttons and other like closure means.

The foregoing description of various and preferred embodiments of the present invention has been provided for purposes of illustration only, and it is understood that numerous modifications, variations and alterations may be made without departing from the scope and spirit of the invention as set forth in the following claims.

What is claimed is:

1. A convertible garment comprising:

a jacket portion with an inner and outer surface; and a pouch on said inner surface of said jacket portion; wherein said pouch is open ended on one side and consists of one continuous drawstring which is looped along the top of said pouch and hangs into said pouch;

wherein said pouch is turned inside out so that said jacket portion folds inside said pouch to form a handbag such that said continuous drawstring when pulled tight closes the open end and further extends the length of said drawstring which is used as both a shoulder strap for said handbag and to close said handbag to secure the contents therein.

2. The convertible garment according to claim 1, further comprising two arm sleeves on said jacket portion.

3. The convertible garment according to claim 1, further comprising a first snap button on the outer surface of the jacket portion and a second snap button on the inner side of the pouch, wherein the jacket portion folds inside the pouch such that said first and second snap buttons connect to form a pocket inside the pouch.

4. The convertible garment according to claim 1, wherein the garment is made from a material selected from the group consisting of cotton, leather, synthetic leather, nylon, fleece, synthetic materials, polyester, rayon, spandex, lace, down and down feathers.

5. A method for converting a convertible garment from a jacket into a handbag comprising:

a convertible garment having a jacket portion with an inner and outer surface; and a pouch on said inner surface of said jacket portion; wherein said pouch is open ended on one side and includes a drawstring;

turning said pouch inside out through said open ended side;

folding said jacket portion inside said pouch to form the handbag;

pulling said drawstring taunt to close said opening wherein said pouch is open ended on one side and consists of one continuous drawstring which is looped along the top of said pouch and hangs into said pouch; and wherein said pouch is turned inside out so that said jacket portion folds inside said pouch to form a handbag such that said continuous drawstring when pulled tight closes the open end and further extends the length of said drawstring which is used as both a shoulder strap for said handbag and to close said handbag to secure the contents therein.

6. The method according to claim 5, wherein said jacket portion includes two arm sleeves.

7. The method according to claim 5, further comprising a first snap button on the outer surface of the jacket portion and a second snap button on the inner side of the pouch, wherein folding said jacket portion inside said pouch such that said first and second snap buttons connect to form a pocket inside the handbag.

8. The method according to claim 5, wherein pulling said drawstring taunt to close said opening leaves excess string on both sides of the pouch and creates shoulder straps for the user.

9. A method for converting a convertible garment from a handbag into a jacket comprising:

a convertible garment having a handbag comprised of an open ended pouch and a draw string with a jacket portion having an inner and outer surface stuffed within said pouch;

turning said pouch inside out through said open ended side;

releasing said jacket portion inside said pouch to form the jacket, wherein said pouch remains on the inside surface of the jacket and wherein said pouch is open ended on one side and consists of one continuous drawstring which is looped along the top of said pouch and hangs into said pouch; and further wherein said pouch is turned inside out so that said jacket portion folds inside said pouch to form a handbag such that said continuous drawstring when pulled tight closes the open end and further extends the length of said drawstring which is used as both a shoulder strap for said handbag and to close said handbag to secure the contents therein.

10. The method according to claim 9, wherein said jacket portion includes two arm sleeves.

11. The method according to claim 9, further comprising a first snap button on the outer surface of the jacket portion and a second snap button on the inner side of the pouch, wherein unsnapping said snap buttons releases said jacket portion inside said pouch.

12. The method according to claim 9, wherein said drawstring on said pouch is loosened to open said pouch to release the jacket portion.

* * * * *